United States Patent [19]

Polanyi

[11] 4,140,905

[45] Feb. 20, 1979

[54] LASER-INDUCED MASS SPECTROMETRY

[75] Inventor: John C. Polanyi, Toronto, Canada

[73] Assignee: The Governing Council of The University of Toronto, Toronto, Canada

[21] Appl. No.: 792,904

[22] Filed: May 2, 1977

[51] Int. Cl.[2] ..... H01J 39/34

[52] U.S. Cl. ..... 250/281; 250/282; 250/423 P

[58] Field of Search ..... 250/423 P, 281, 282, 250/292, 288

[56] References Cited

U.S. PATENT DOCUMENTS

| | | | |
|---|---|---|---|
| 3,521,054 | 7/1970 | Webb | 250/423 P |
| 3,937,956 | 2/1976 | Lyon | 250/423 P |

OTHER PUBLICATIONS

"Photofragment Spectrometer" Busch et al., Univ. Cal. vol. 41, No. 7, pp. 1066–1073.

"Laser Isotope Separation" Gross, Optical Engin. Dec. 1974, pp. 506–515.

"Ballistic Mechanism for Vib. and Rot. Energy Transfer in Art CsI Collision" Loesch et al., Journ. of Chem. Phy. vol. 57, No. 5 Sept. 1972, pp. 2038–2050.

*Primary Examiner*—Alfred E. Smith
*Assistant Examiner*—B. C. Anderson
*Attorney, Agent, or Firm*—Hirons & Rogers

[57] ABSTRACT

Gases or gas mixtures are analyzed by a device and process involving laser-induced vibrational excitation of the gases or mixtures, followed by mass spectrometry. A sample of the gas is subjected to radiation, preferably infrared radiation, from a tunable laser, so as to casue vibrational-excitation of the sample by absorption of the radiation. The sample so treated is then subjected to mass spectrometry, which detects changes in the vibrational-excitation of the sample. Detection of such changes indicates infrared absorption by the sample at the wavelength at which the tunable laser is set. The wavelength of infrared absorption so determined is a characterizing property of the sample.

9 Claims, 1 Drawing Figure

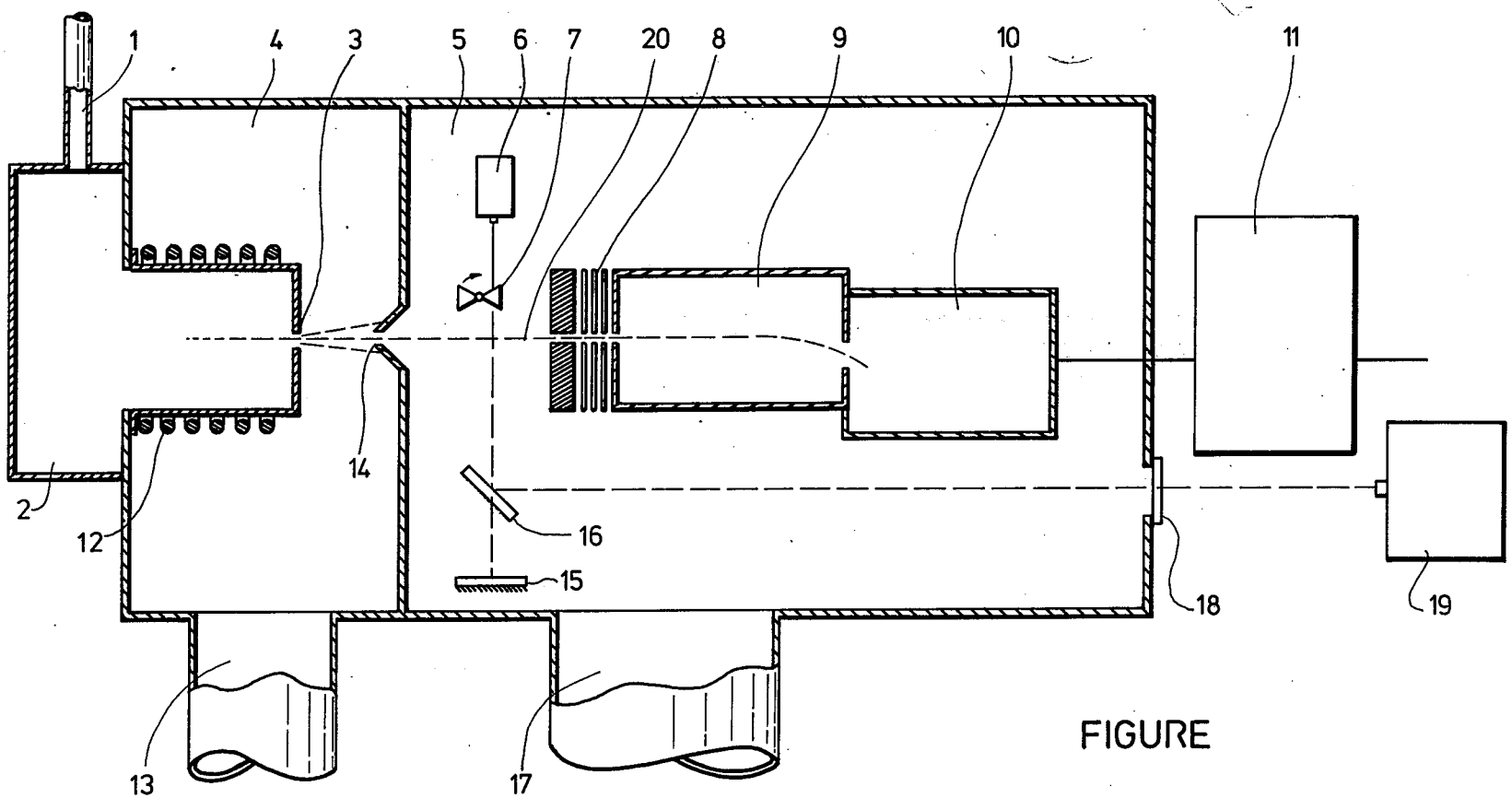
FIGURE

LASER-INDUCED MASS SPECTROMETRY

FIELD OF THE INVENTION

This invention comprises a method and device for analyzing gases or gas-mixtures by laser-induced vibrational excitation followed by mass-spectrometry. The molecular species being analyzed, in the novel device and process described herein, are detected by a combination of (a) measuring the wavelength of the incident laser beam and (b) measuring the effect of the laser vibrational-excitation on the mass-spectrum recorded by the mass-spectrometer.

BACKGROUND OF THE INVENTION AND PRIOR ART

The absorption of infrared laser radiation to produce vibrational excitation constitutes, by itself, a well-known method of gas-analysis. The wavelengths of the laser radiation that are absorbed and the amount of absorption are highly characteristic of individual molecular species. They also serve, in devices already on the market, to characterize the state of vibrational and rotational excitation of the absorbing species. Such analytic devices, based on measurement of the amount of infrared radiation absorbed from incident laser radiation, may be termed "infrared (laser) absorption spectrometers". The infrared absorption characteristics of a vast number of molecules have been measured and compiled in connection with these existing devices.

The conventional infrared absorption method of analysis, though highly specific, suffers from the drawback of moderate sensitivity. Such an instrument may, for example, measure approximately 0.1% absorption. This constitutes a small percentage change in the laser intensity which, owing to the high intensity, may, however, represent a substantial amount of infrared absorption, i.e. a large fractional change in the number of vibrationally-excited molecules in the sample gas being illuminated.

BRIEF SUMMARY OF THE INVENTION

Instead of measuring a small percentage change in the laser intensity, it is greatly preferable to measure a large percentage change in the extent of vibrational-excitation of the sample under analysis. In the present invention this is the approach taken, since a mass-spectrometer is used to measure the change in vibrational-excitation of the sample.

A mass-spectrometer ionises a sample gas (i.e. makes charged species from it) and then measures the masses of the ions, and the yields of the ions. The masses in question go someway towards characterizing the chemical nature of the species in the sample, whereas the ionic yields relate to the concentration of the species in the sample under analysis. As an analytic tool it exhibits complementary strengths and weaknesses as compared with infrared absorption spectroscopy: it is highly sensitive but quite often it is ambiguous in its identification of the chemical species. The ambiguity stems from two causes. In the first place the process of forming ions is itself the source of new chemical species ("fragment ions"), i.e. this is an obtrusive method of analysis. Secondly it often happens that more than one ionic species could have the observed mass. Since mass is customarily the only observable, the identification is left in doubt.

It is an object of the present invention to provide a novel method for gas analysis.

It is a further object of the invention to provide a new device for gas analysis, which utilizes laser-induced vibrational excitation of the gas, followed by mass spectrometry.

The device of the present invention, the laser-induced mass spectrometer (LIMS), and the method of the invention, combine the high specificity of absorption spectroscopy with the high sensitivity of mass spectrometry.

BRIEF REFERENCE TO THE DRAWING

The accompanying FIGURE shows, in diagrammatic vertical cross section, an apparatus in accordance with the invention.

DESCRIPTION OF THE PREFERRED EMBODIMENTS

The device is pictured in the appended figure. It comprises a sample inlet 1 communicating with a source 2 in which a gas sample to be analyzed is received. From the source 2, the gas under analysis passes through a source aperture 3 into a first chamber 4. The size of source aperture 3 is chosen so that the background pressure in the first chamber 4 is from about $10^{-3}$ to $10^{-4}$ torr (1 torr is 1 mm of Hg, hence 760 torr equals 1 atmosphere). From the first chamber 4, the jet of molecules of the gas sample under analysis is passed through a skimmer 14 into a second chamber 5, as a molecular beam 20. The background pressure of the second chamber 5 is from about $10^{-5}$ to $10^{-7}$ torr. The beam of molecules 20 is directed into an ionizer 8 of a mass spectrometer of known type, having a mass filter 9. The mass filter 9 of the mass spectrometer may, for example, be a quadrupole mass analyzer; other designs of mass filter as known in the mass spectrometer art can be used if desired. The ion current, following mass filtering, is amplified in an ion multiplier 10 of the mass spectrometer, and further amplified by a lock-in amplifier 11.

Immediately prior to entering the ionizer 8, the molecular beam 20 is irradiated by a tunable laser 6, supplying laser radiation to the molecular beam 20 in second chamber 5 in a direction normal to that of the molecular beam 20. Most commonly this laser will produce vibrational excitation in the sample molecules (which constitute the molecular beam 20), by infrared absorption. (Vibrational excitation can alternatively be produced by laser absorption in the visible or ultraviolet, leading to electronic excitation followed by radiation to vibrationally-excited levels of the ground electronic state.) The laser beam is interrupted at frequency f by a modulator blade 7, which comprises a rotating opaque disc of metal as known in the art, adapted to rotate in the path of the laser and hence interrupt it and cause pulsing of the laser at a set frequency.

After passing through the molecular beam 20, the pulsed laser encounters a beam splitter 16 of known type, which causes a portion of the laser beam to be reflected forwardly of the instrument, through the second chamber 5 and out of a window 18 of a suitable material transparent to laser radiation over the appropriate range of wavelengths, located in the end wall of the main body of the instrument. From the window 18, this split portion 21 of the laser beam is received in an infrared spectrometer for determination and recording of the wavelength of the laser beam. The remainder of the split laser beam, passing through the beam splitter 16, encounters a mirror 15, by means of which it is reflected back towards the molecular beam 20.

A first pump 13 is provided, communicating with first chamber 4, so as to ensure the necessary low pressures are maintained within that chamber. Similarly, a second pump 17 is provided in communication with the second chamber 5, to maintain the pressure of that chamber within the desired range.

The outlet portion of the source 2 is surrounded by a suitable heating device such as a heating coil 12, so as to maintain and control the temperature of the sample being analyzed.

The procedure for operating the laser-induced mass spectrometer, LIMS, is to set the laser at a wavelength $\lambda_1$ and then to record a mass-spectrum (or selected portion of a mass spectrum) by way of the lock-in amplifier 11 locked to the laser-modulation frequency f established by the modulator blade 7. Using this method of amplification, the device records only that part of the spectrum that bears the imprint of the laser-modulation, i.e. it records only changes in the mass peaks m of selected species as determined by the mass spectrometer.

The laser-modulation frequency will be imprinted on the mass spectrum (a) to the extent that the sample absorbs at wavelength $\lambda_1$, and (b) to the extent that the mass-spectrometer is sensitive to vibrational excitation of the sample. The first of these two factors is the essential information in identifying the molecule (or molecular fragment) which is under analysis, and the concentration of that species. The second of these factors must be determined by calibrations of the mass-spectrometer using known gases or gas mixtures, so that the magnitude of changes detected in the mass peaks m, which changes are related to the amount of absorption at $\lambda_1$, can be related back to concentrations of the specific gas that is known to absorb at $\lambda_1$. (A similar calibration procedure is required in conventional mass-spectrometry in which the only data are the mass and yields of the ions, rather than, as in the present case, the mass and yields of the ions and the wavelength setting of the tunable laser.)

It has only recently become evident that mass spectrometers are sensitive to the vibrational state of the molecule or molecular fragment under analysis. Associated with every vibrational state, v, there is a rotational state, J. The tunable laser in the present device will excite both v and J. Since, however, the major part of the excitation will usually be in v, we shall couch the following discussion in terms of the effect of changing v. It should be understood that the same considerations apply to changes in J, if significant change in J occurs. The generic term for excitation of both v and J is "internal excitation". The following paragraphs enlarge on some of the ways in which internal excitation of molecules affects the mass-spectrum. Any effect of the internal excitation of the molecular species can be used in the present application since all that is required is a measure of the precise wavelengths $\lambda_1$, $\lambda_2$, $\lambda_3$.... etc. which the sample gas absorbs, and a measure of the extent to which wavelengths $\lambda_1$ (and $\lambda_2$, $\lambda_3$.... etc.) are absorbed by the sample gas. Prominent among the effects of internal excitation on mass spectra are:

(i) alteration in the relative yields of fragment to parent ions, (ii) alteration in the yield of ions at a given mass due to changed ionization probability, (iii) altered rate of removal through ion-molecule reaction in the ionizer, and alteration in the yield of ions which come from the products of such ion-molecule reaction, (iv) alteration in the translational energy (i.e. speed of motion) of the fragment ions, evidenced, for example, by change in the breadth of the peaks in the mass spectrum.

All of these effects are more clearly evidenced in the case that the process of ionization is such as to transfer better defined energy to the species being ionized. There are several ways in which this can be accomplished. In electron-impact ionization one can achieve this objective by narrowing the spread of energies in the electron beam. Alternatively, use can be made of Penning ionization in which the sample molecule is ionized by collision with an electronically excited atom such as Ar* (electronically-excited argon). A further alternative procedure is to use "chemi-ionization", in which an ionic beam replaces the electron beam of the ionizer. An example of chemi-ionization would be the use of $CH_5^+$ which readily transfers a proton to the sample molecule, to yield a positively charged ion.

The effect that depends on ion-molecule reaction (item iii above) is greatly enhanced if a secondary beam of molecules passes transversely through the ionizer (directed into the opening of Pump 17). The same effect (item iii) is greatly enhanced if the ion-molecular reaction has a small energy-barrier, as is the case for endothermic ion-molecule reaction. This will influence the choice of secondary beams.

EXAMPLE

The following is a specific example of the particulars of an analysis that can be made with the present device and according to the process of the present invention, and of the procedure to be followed.

In this example, the trace gas under analysis is carbon dioxide. A total sample pressure of 100 torr is used. The source aperture 3 is set at 0.3 mm. The temperature of the heater 12 is adjusted so that the $(CO_2)_2$ dimer peak recorded on the mass filter is negligible.

In order to maintain the necessary pressure, Pump 13 communicating with first chamber 4 is set to pump at a rate of 2,000 liters per second, thereby maintaining a pressure in chamber 4 of less than about $10^{-3}$ torr. Similarly, Pump 17 communicating with chamber 5 is set to pump at a rate of 2,000 liters per second, so as to maintain the pressure in chamber 5 at or below about $10^{-5}$ torr. The skimmer 14 orifice is set to a diameter of 1 mm. The laser used is a tunable diode lead-salt laser, as commercially available. The distance from the skimmer to the laser beam is set to be 3 cm, the distance from the source aperture 3 to the skimmer is set to be 5 cm., and the distance from the skimmer 14 to the ionizer 8 of the mass-spectrometer is set to be 6 cm. The modulator blade 7 is set so as to modulate the laser beam at a frequency of 13 Hz. The beam splitter used was a calcium fluoride plate, 10% reflective. The window 18 was of calcium fluoride. A standard, commercially available infrared spectrometer 19 was used, to receive the split portion of the laser beam. The lock-in amplifier 11 is accordingly set to a frequency of 13 Hz, in accordance with the setting of the modulator 7.

For carbon dioxide in its lowest vibrational state, infrared absorptions occur at wavelengths 1933 $cm^{-1}$; 2077 $cm^{-1}$; 2349 $cm^{-1}$; 3609 $cm^{-1}$; 3716 $cm^{-1}$; 4861 $cm^{-1}$; 4984 $cm^{-1}$; and 5109 $cm^{-1}$. As the tunable laser is set to any one of these absorption frequencies, the carbon dioxide molecular stream 20 absorbs part of the infrared laser radiation, vibrational-excitation changing the vibrarional-excitation of the carbon dioxide.

The mass filter is set to measure fragment peaks of m=28, 16 and 12 and the parent peak at m=44 a.m.u. (atomic mass units). The absorption of laser radiation is signalled by a change in the yield of ions at the various masses m and most often also by a change in fragment/-parent peak ratio R. The amount of absorption, and hence the amount of carbon dioxide in the sample, is given by the magnitude of the above mentioned changes.

As noted above, a calibration with pure sample gas $CO_2$ is required, in order to establish the relationship between the concentration of carbon dioxide in the source chamber and the yields of ions at the masses m. Once such calibrations are done, the apparatus and process according to the invention can be used to determine amounts of carbon dioxide in gas samples.

It will further be appreciated that the laser can be mounted externally of the apparatus as a whole. It does not have to be positioned inside the chamber 5 of the apparatus. The compact lead-salt laser lends itself conveniently to internal mounting.

It will further be appreciated that, if the tunable laser has adequate wavelength calibration, then the use of a spectrometer 19, and a beam splitter 16, is not required. Sufficiently accurate readings of wavelength of the laser, when absorption is experienced as signified by the mass spectrometer, can in such cases be obtained from the tunable laser itself, without using the spectrometer.

The use of a lock-in amplifier 11, set at the same frequency as the modulation of the laser is a preferred method of operating according to the invention, although not esssential. The specific frequency of modulation of the laser is chosen and fixed on the grounds of convenience. Substantially any frequency can be chosen, provided that it is distinct and remote from outside interference. Effectively, the use of the lock-in amplifier technique as described herein enables one to measure directly the differences in the mass peaks of the ions detected by the mass spectrometer, as between the molecular beam upon which the laser radiation has been incident, and the molecular beam without subjection to any such laser radiation. Such lock-in amplifiers and techniques are standard equipment where a change in some quantity must be measured precisely, so that they do not require detailed description here.

The apparatus and process of the invention is particularly well adapted to the detection of very low absorptions of laser radiation, of the type which might be insignificant or of doubtful significance in connection with normal laser infrared spectroscopy. By measuring the effect caused by absorption of the radiation, namely the change in population of vibrationally excited species, in the gas mixture, one is able to detect much smaller degrees of infrared absorption, since the magnitude of the effect caused is large in comparison with the amount of absorption required to cause this effect. Hence, greater sensitivity of measurement is obtained, coupled with the specificity of infrared absorption spectroscopy, which permits characterization of the chemical nature of the species under analysis, and additionally its state of vibrational and rotational excitation.

What I claim is:

1. A method for the spectroscopic analysis of gas which comprises:

causing internal excitation of molecules of the gas by irradiating a sample of the gas with infra-red laser radiation having a wavelength which is absorbed by the sample;

subjecting the laser irradiated sample to electron-impact ionization;

mass filtering the ionized, laser irradiated sample to isolate an ionized species in said sample;

comparing the amount of said ionized species in the irradiated, ionized sample with that in a similar ionized but nonirradiated sample.

2. The method of claim 1 wherein the sample is irradiated by scanning with infra-red laser radiation in a range of wavelengths from a tunable infra-red laser, to locate said infra-red laser radiation wavelength which is absorbed by the sample.

3. The method of claim 1 including the step of amplifying the ion current produced by the ionized sample after mass filtering, by means of an ion multiplier and an amplifier.

4. The method of claim 3 including the step of modulating the laser radiation prior to irradiating the sample therewith, said amplifier being a lock-in amplifier set to the frequency of modulation of the laser radiation.

5. Apparatus for the spectroscopic analysis of gas which comprises:

A first chamber;

means for directing a sample of gas to be analyzed through said first chamber as a gas stream;

A second chamber;

a skimmer orifice permitting passage of a portion of said sample gas stream from the first chamber to the second chamber;

a tunable infra-red laser adapted to irradiate the sample gas stream with infra-red laser radiation as it passes through the second chamber and cause internal excitation of the molecules of said gas stream therein;

a mass spectrometer, including an electron-impact ionizer and a mass filter, adapted to receive the sample gas stream after its irradiation and to record at least a portion of the mass spectrums thereof, for comparison with a corresponding portion of the mass spectrum of a similar ionized but non-irradiated sample.

6. Apparatus according to claim 5 including a modulator adapted to modulate the laser irradiation to a given frequency and a lock-in amplifier adapted to amplify the ion-current produced in the mass spectrometer, said lock-in amplifier being set to the frequency of modulation of the laser radiation.

7. Apparatus according to claim 5 wherein the means directing the gas sample includes heating means adapted to heat the gas sample.

8. Apparatus according to claim 6 including a beam splitter adapted to split the laser radiation, and a spectrometer adapted to receive a portion of the laser radiation from said beam splitter and indicate the wavelength thereof.

9. The method claim 2 wherein the ratio of the yield of fragment ions to parent ions in the ionized, mass filtered, infra-red laser irradiated gas sample is compared with the ratio of fragment ions to parent ions in a similarly ionized, mass filtered, but non-irradiated sample of the gas.

* * * * *